US006539572B2

(12) United States Patent
Ware

(10) Patent No.: US 6,539,572 B2
(45) Date of Patent: Apr. 1, 2003

(54) AUTOMOTIVE MAINTENANCE RAMP

(76) Inventor: Ressie Lynn Ware, 2289 State Rte. 756, Moscow, OH (US) 45153

( * ) Notice: Subject to any disclaimer, the term of this patent is extended or adjusted under 35 U.S.C. 154(b) by 0 days.

(21) Appl. No.: 09/803,619

(22) Filed: Mar. 8, 2001

(65) Prior Publication Data

US 2001/0044978 A1 Nov. 29, 2001

Related U.S. Application Data

(60) Provisional application No. 60/188,122, filed on Mar. 9, 2000.

(51) Int. Cl.[7] ..... E02C 3/00

(52) U.S. Cl. ..... 14/69.5; 254/88

(58) Field of Search ..... 14/69.5, 71.1; 248/352; 254/88; 119/847; 414/530, 921; 296/61

(56) References Cited

U.S. PATENT DOCUMENTS

| | | | | | |
|---|---|---|---|---|---|
| 1,647,935 | A | * | 11/1927 | Scholler | 254/88 |
| 1,871,129 | A | * | 8/1932 | Pierce | 254/88 |
| 3,178,156 | A | * | 4/1965 | Rigers | 254/88 |
| 4,103,870 | A | * | 8/1978 | Murakami | 254/88 |
| 4,421,300 | A | | 12/1983 | Lundman | 254/88 |
| 4,427,179 | A | * | 1/1984 | Price | 254/88 X |
| 4,836,501 | A | * | 6/1989 | Baer | 254/88 |
| 4,920,596 | A | | 5/1990 | Stevens | 14/69.5 |
| 5,176,361 | A | * | 1/1993 | Ayala, III | 254/88 |
| 5,209,458 | A | * | 5/1993 | Eubank et al. | 254/88 |
| 5,743,689 | A | | 4/1998 | Schlaeger | 410/30 |
| 5,933,898 | A | * | 8/1999 | Estes et al. | 14/69.5 |
| 6,314,602 | B1 | * | 11/2001 | Wallen | 14/69.5 |

FOREIGN PATENT DOCUMENTS

| | | |
|---|---|---|
| DE | 2521439 | * 11/1976 |
| GB | 2088821 | * 6/1982 |

OTHER PUBLICATIONS

Internet article, "AlumiRamp Inc.", pp. 1–11, Apr. 2, 2002.*
Internet article, "Motor Traders", pp. 1–2, Apr. 2, 2002.*
www.supplierpipeline.com/automotive/carramps.asp; "*Car Ramps & Extensions*", 1 pg.; Jun. 27, 2001.
www.cougar–devs.demon.co.uk/products/garageeqptpages/carramps.htm; "*Technical Ramp Specifications*", 1 pg.; Jan. 26, 2000.
store.yahoo.com/mossmotors/400–800.html; "*Rhino Ramps*", 1 pg.; Jan. 26, 2000.
www.teleport.com/~sumprod/how_tof.htm; "*How to Use Sno–Chain Ramps*", 3 pgs.; Jan. 26, 2000.
www.calcarcover.com; "*Ramps & Wheel Chocks*", 2 pgs.; fall, 1999.

* cited by examiner

*Primary Examiner*—David Bagnell
*Assistant Examiner*—Sunil Singh
(74) *Attorney, Agent, or Firm*—Frost Brown Todd LLC

(57) ABSTRACT

A portable stair-step automotive maintenance ramp having a foldable approach ramp which may be folded atop the ramp for compact storage when not in use and unfolded for use. A foldable wheel barrier is also provided to prevent the vehicle from rolling off of the ramp as the vehicle is driven up upon the ramp.

6 Claims, 7 Drawing Sheets

AUTOMOTIVE MAINTENANCE RAMP

RELATED APPLICATIONS

This application claims the priority of Provisional Application Serial No. 60/188,122, filed on Mar. 9, 2000, entitled "FOLDABLE RAMP AND METHOD OF ELEVATING A VEHICLE".

BACKGROUND OF THE INVENTION

The field of the invention generally relates to portable vehicle maintenance ramps and more particularly pertains to an improved new vehicular maintenance ramp utilizing a foldable stair-step design and method for elevating vehicles using said ramp where mechanical lifts are not available for the repair and/or maintenance of vehicles.

PRIOR ART

A typical prior art vehicle ramp includes a supporting structure or platform for supporting the wheel of a vehicle off the ground and an integral inclined plane connected to the supporting platform whereby the vehicle wheel is driven up onto the supporting structure. In normal use a pair of such ramps are typically employed and the wheels, preferably both front or both rear wheels, of the vehicle are driven up the inclined plane onto the supporting structure or platform.

Typical of such prior art is U.S. Pat. No. 4,421,300 wherein an inclined vehicle ramp is disclosed with an upper horizontal surface for supporting a vehicle wheel. Similar ramp designs allow an automotive vehicle to be driven up onto the ramp (one ramp per wheel) thereby elevating the vehicle. Such prior art ramps, however, are not foldable for ease of storage when not in use and thereby present obvious storage problems because of there inherent bulk and/or size.

Accordingly, it may be appreciated that there is a need, particularly in the amateur,"do it yourself", automotive repair industry, for a new and improved means to elevate an automotive vehicle thereby providing adequate clearance. underneath the vehicle.

SUMMARY OF THE INVENTION

The purpose of the present invention is to provide apparatus and method for elevating a vehicle thereby providing adequate clearance to work under the vehicle. The present invention generally comprises a foldable stair-step ramp having a main, support body including at least two stepped elevations, or courses, and a leading step hinged to said main body thereby creating a stair-step ramp in its open functional configuration.

The stair-step type of construction as disclosed herein, allows the user to select the height to which he elevates the vehicle and provides compact storage of the ramp when it is not in use. Furthermore, the stair step design decreases the possibility of roll-off as the driver can "feel" each step of the ramp as it is traversed. The stair step design further prevents ramp shifting inherent with traditional prior art inclined ramps. Finally, the design of the current invention provides greater stability of the vehicle when it is on the ramp.

DETAILED DESCRIPTION OF THE PREFERRED EMBODIMENT

Figure 1:
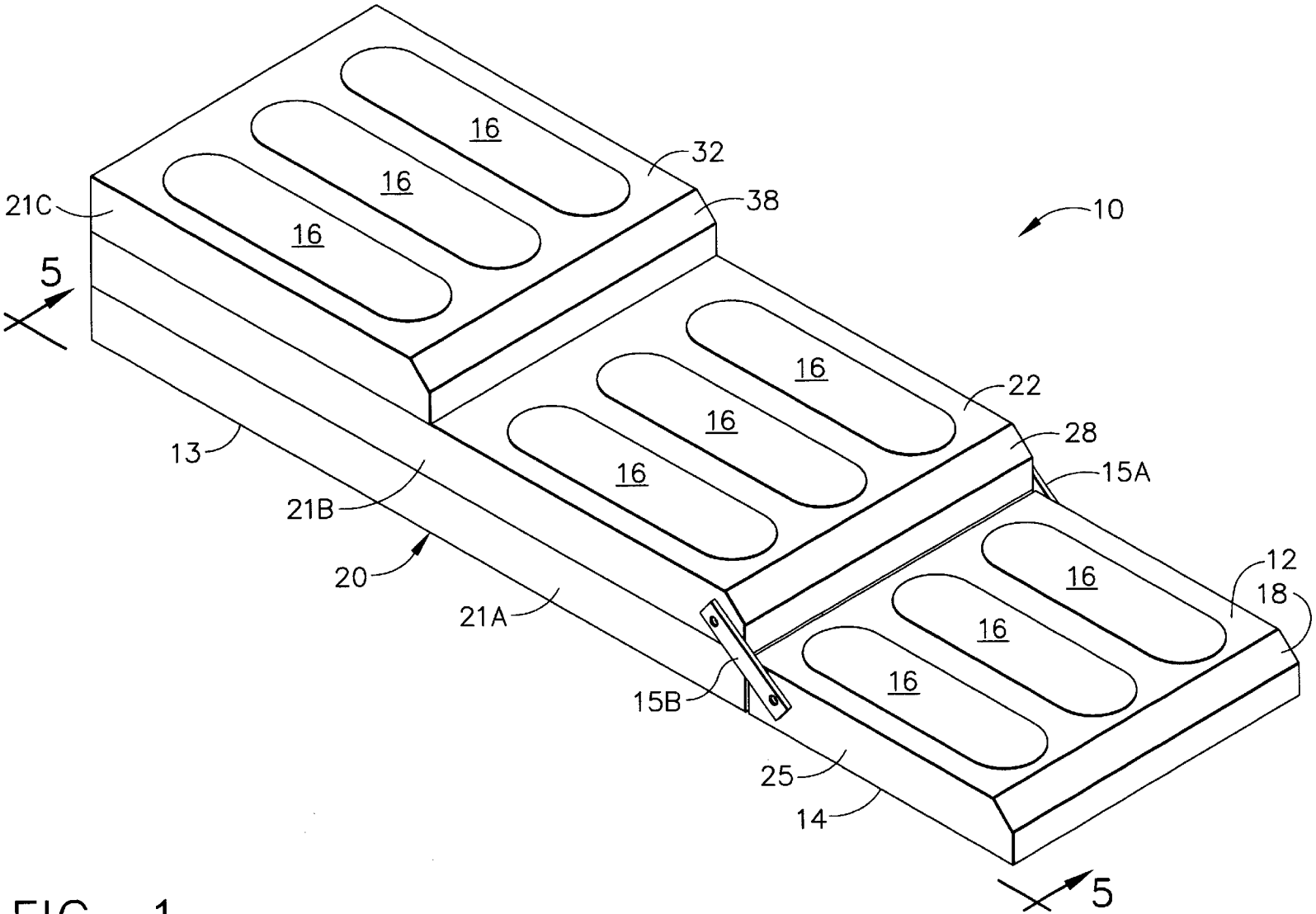
FIG. 1 presents a pictorial view of the preferred embodiment of my stair-step ramp in its unfolded and functional configuration.
Figure 5:
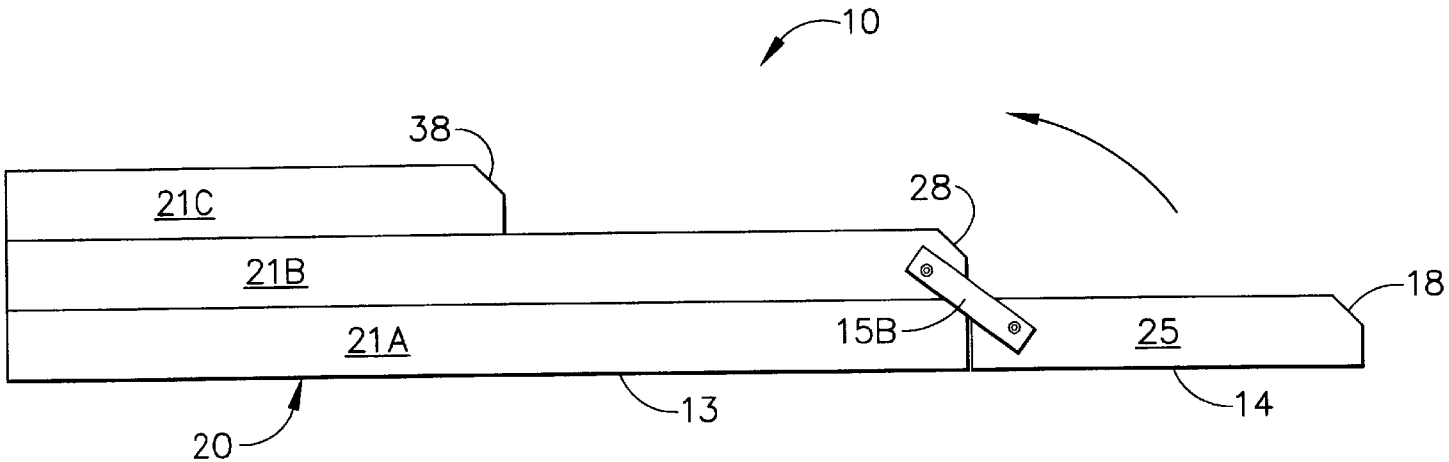
FIG. 5 presents a side elevational view of my stair-step ramp, taken along line 5—5 in FIG. 1, showing the ramp in its unfolded and functional configuration.

FIG. 1 presents a pictorial view of my improved automotive maintenance ramp 10 in its open, or deployed, and usable configuration. Referring now to FIGS. 1 and 5, ramp 10 basically comprises a first level 12, a second level 22 and a third level 32. The main body 20 includes the second level 22 and the third level 32 with the first level 12 comprising a separate initial step 25.

Figure 2:
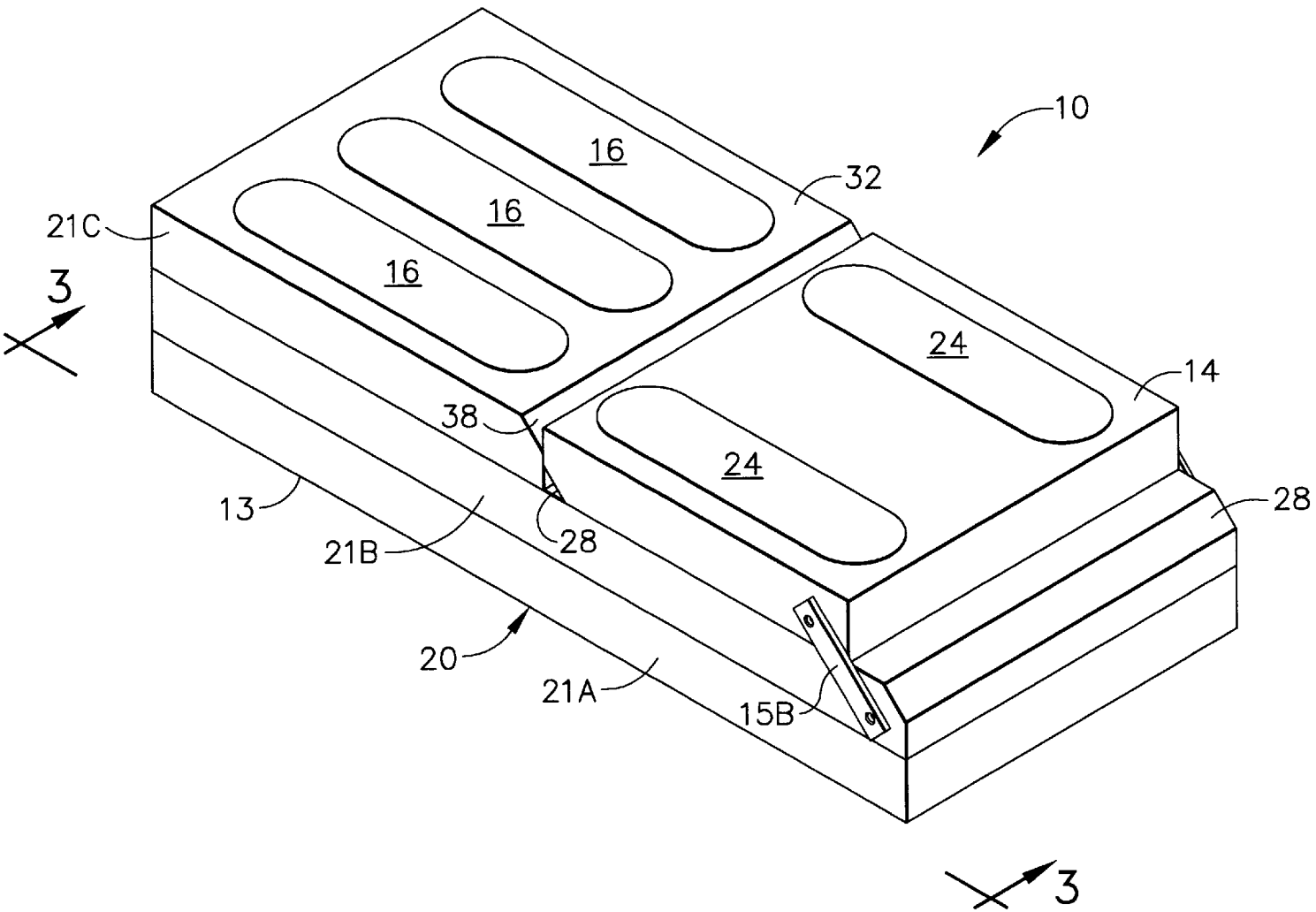
FIG. 2 presents a pictorial view of the preferred embodiment of my foldable step-stair ramp in its folded or stored configuration.
Figure 4:
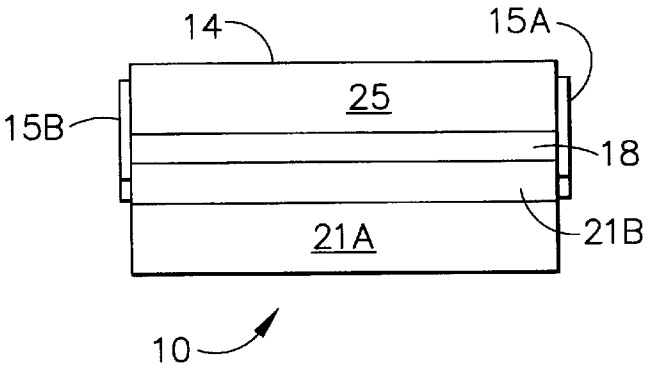
FIG. 4 presents an end elevational view, taken along line 4—4 in FIG. 3, showing my stair-step ramp in its folded or stored position.
Figure 3:
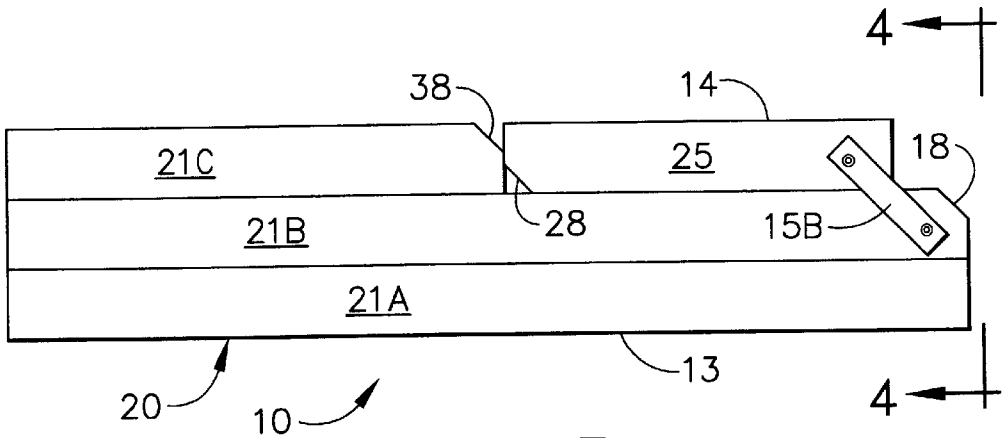
FIG. 3 presents a side elevational view, taken along line 3—3 in FIG. 2, showing my stair-step ramp in its folded or stored position.
Figure 9:
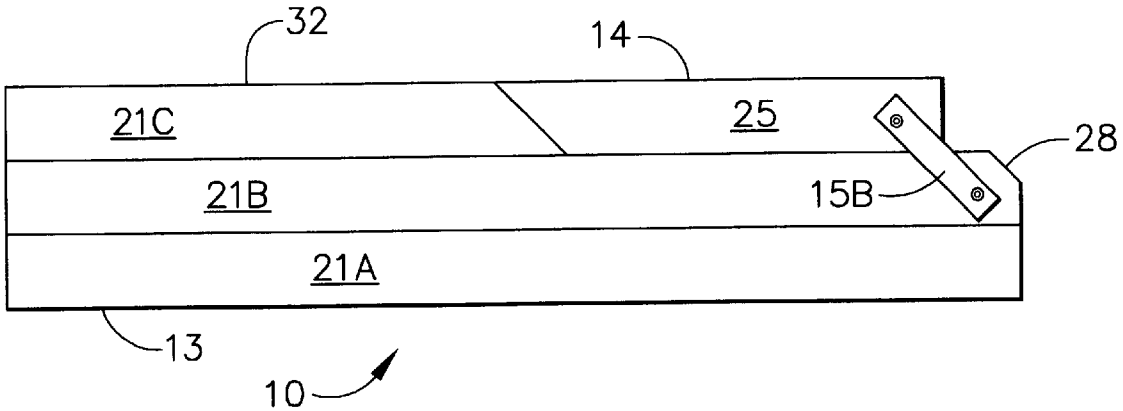
FIG. 9 presents a side elevational view, similar to that of FIG. 3, showing a second alternate embodiment of my stair-step ramp in its folded or stored configuration.

The main body 20 may comprise three separate courses or blocks 21A, 21B and 21C each laminated to one another forming a combined main body, as illustrated in FIG. 1, or may be formed as a unitary, one piece, body. Leading step 25 is hingedly attached to main body 20 by any convenient hinge mechanism, such as hinge straps 15A and 15B as illustrated in FIG. 1. Preferably each level 12, 22, and 32 are provided with non-skid friction surfaces 16 comprising a course grit type of material. Friction surfaces 16 may be adhesively attached directly to levels 12, 22, and 32 or they may comprise an adhesively attached laminate material. Similarly friction laminates 24 (FIG. 2) may be placed on the bottom surfaces 13 and 14 of main body 20 and step 25 respectively to prevent sliding of ramp 10 upon the floor surface as a vehicle is driven onto the ramp. Also preferably provided at each step level is a leading chamfered surface 18, 28, and 38. Alternatively, chamfers 18 and 38 may be replaced by beveled edges 18A and 38A as illustrated in FIGS. 9 and 10.

Figure 10:
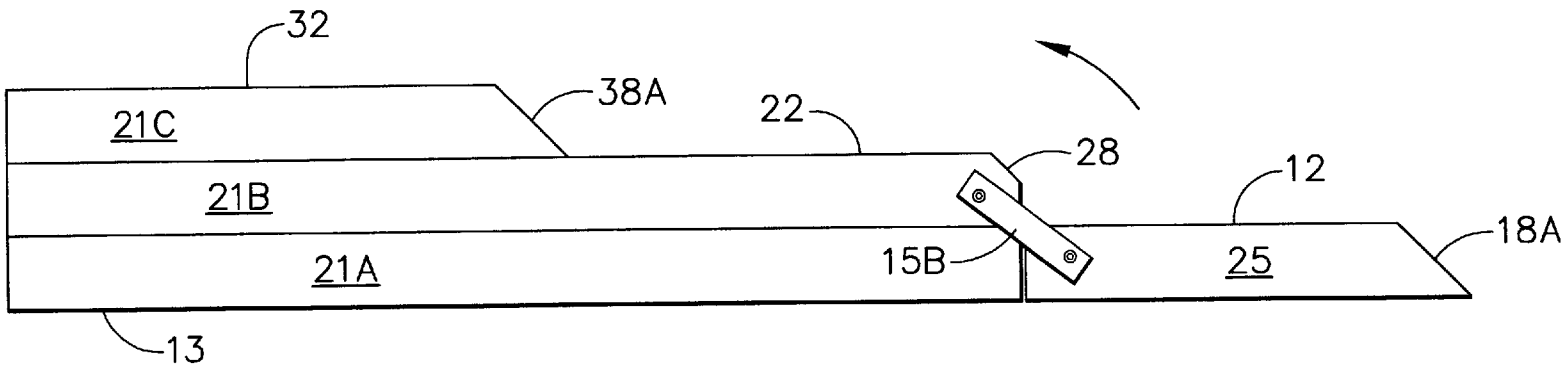
FIG. 10 presents a side elevational view, similar to that of FIG. 5, showing the second embodiment of FIG. 6 in its unfolded functional configuration.

Ramp 10 would be used as shown in FIGS. 1, 5 and 10. A series of stair steps 12, 22, and 32 are thereby provided whereby, the vehicle, wheel or wheels, preferably two (both front or both rear) would be driven up onto level 12 followed by level 22 and ultimately onto level 32 thereby elevating the vehicle whereby easy access would be obtained for a person to perform necessary repairs and/or servicing under the vehicle.

The driver as he drives up upon ramp 10 may elect to stop the vehicle on the first level 12, may proceed to and stop on the second level 22 or he may proceed to the top level for maximum height above the ground. Thus the user may select and place the vehicle at the height appropriate for the repair that he intends to conduct.

Friction areas 16 provide improved friction between the ramp surface and the vehicle tire. Further friction surfaces 24, upon the bottom surfaces 14 and 13 provide improved frictional engagement between the ramp and the floor surface thereby preventing the ramp from moving as the vehicle is driven up onto the ramp steps. The vehicle is removed from the ramp by merely backing the vehicle down off the ramp.

Optionally, courses 21B and 21C may be separable from one another whereby a two course ramp may be configured by removal of course 21C, or a one course ramp may be configured by removal of course 21C and 21B thereby providing a height adjustable ramp. Although only three courses, or levels, are illustrated in the accompanying drawings, it is understood that additional courses may be added to suit the end users needs and or requirements.

Figure 6:
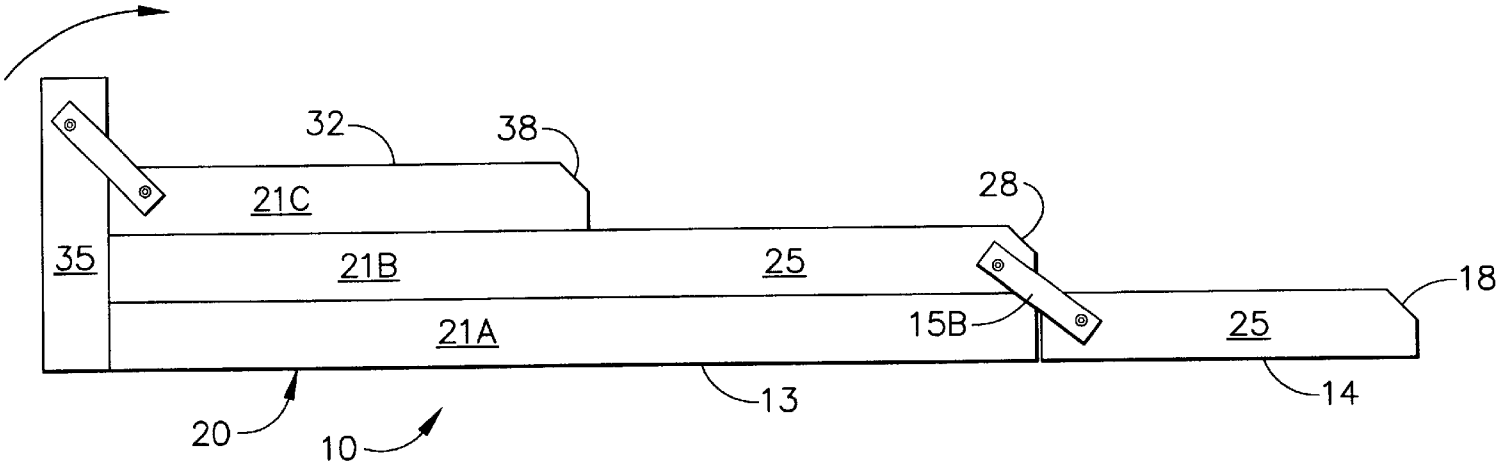
FIG. 6 presents an elevational view, similar to that of FIG. 5, of a first alternate embodiment of my step-stair ramp including a foldable end guard.

During periods of non use, ramp 10 may be compactly stored by folding leading step 25 upward and over top of the main body 20 as indicated by the arrows in FIGS. 5, 6, and 10 thereby presenting a compact and easily storable configuration as illustrated in FIGS. 2,3,4, and 9.

Figure 8:
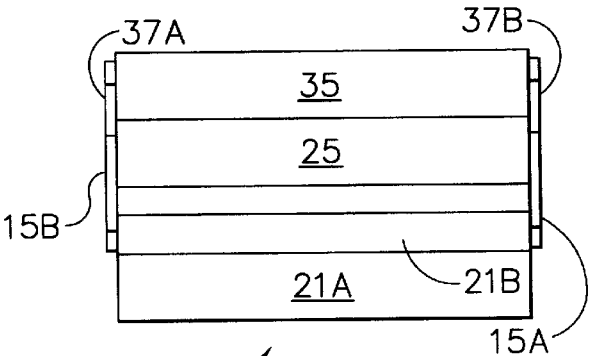
FIG. 8 presents an end elevational view, taken along line 8—8 in FIG. 7.
Figure 7:
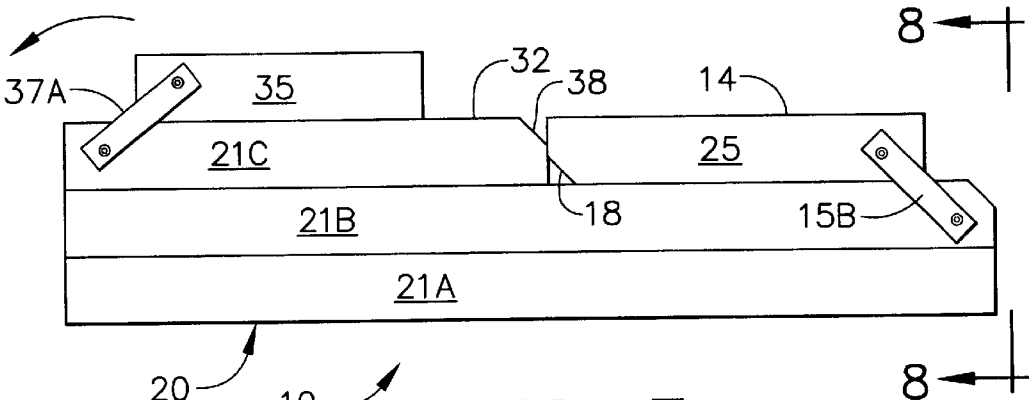
FIG. 7 presents a side elevational view, similar to that of FIG. 3 showing my first alternate embodiment having the end guard in its folded configuration.

FIGS. 6 through 8 present a further alternate embodiment of my automotive stair step ramp wherein a foldable end block or wheel barrier 35 has been hingedly attached to main body 20 by hinge straps 37A and 37B. Barrier 35 is conveniently stored by folding it atop course 21C as illustrated in FIG. 7. For use, barrier 35 is rotated, upon hinges 37A and 37B into its functional position as illustrated in FIG. 6 whereby barrier 35 acts as a vehicle wheel stop thereby preventing the vehicle wheel overrunning course 21C as the vehicle is maneuvered into position upon the ramp. Although wheel barrier 35 is illustrated as being foldable about hinges 37A and 37B, barrier 35 may alternately be permanently affixed to main body 20.

Figure 11:
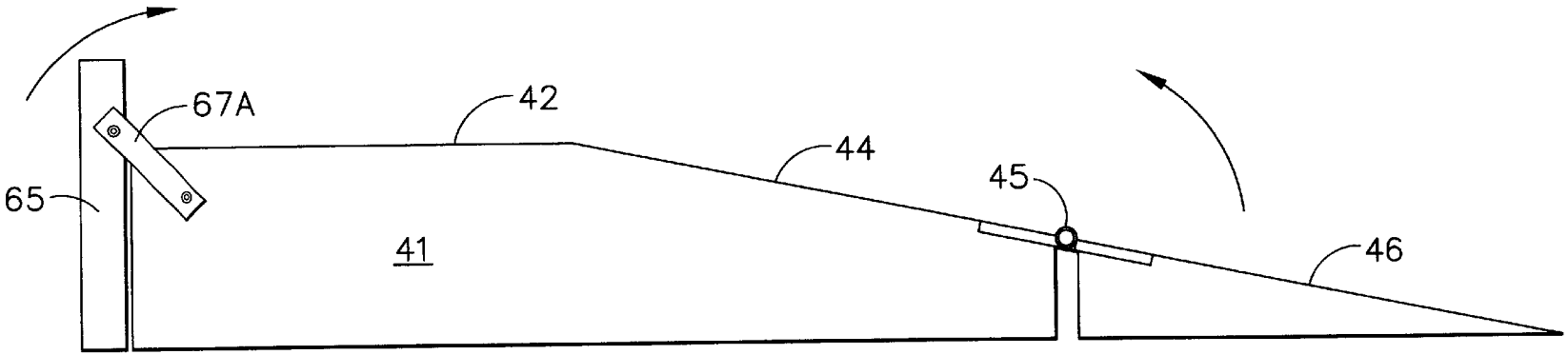
FIG. 11 presents a side elevational view of the third embodiment of my ramp in its unfolded functional configuration.
Figure 13:
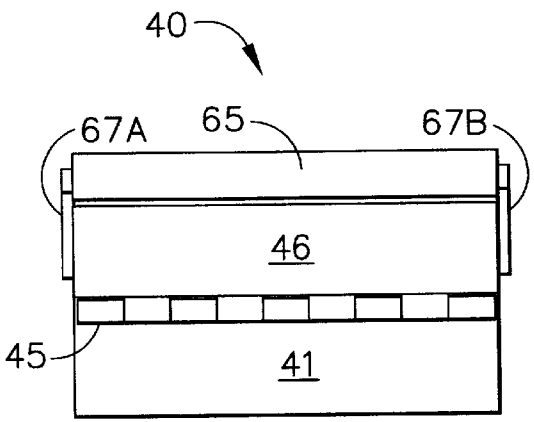
FIG. 13 presents an end elevational view, taken along line 13—13 in FIG. 12, showing the third embodiment of my ramp in its folded or stored configuration.
Figure 12:
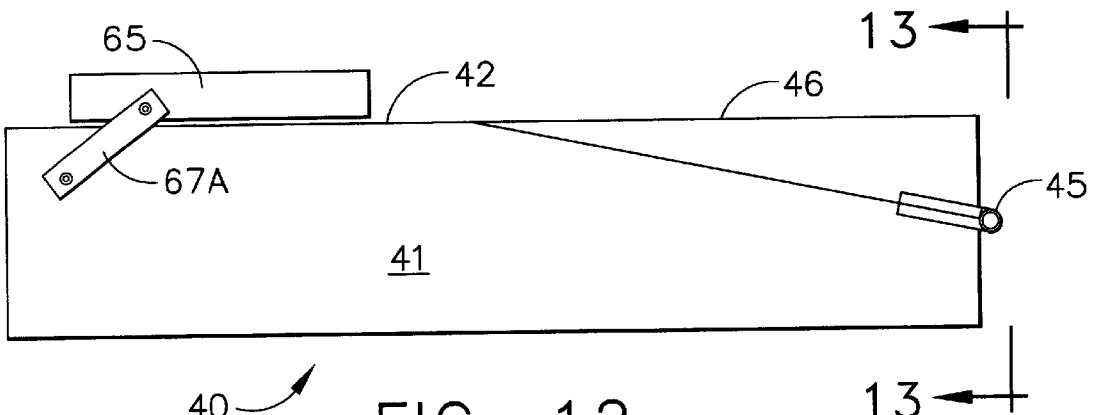
FIG. 12 presents a side elevational view of a third embodiment of my ramp in its folded or stored configuration.

A third alternate embodiment 40 of my improved automotive wheel ramp is illustrated in FIGS. 11 through 13. As illustrated in FIG. 11 a unitary main body 41 is provided having a flat upper surface 42 and a inclined portion 44. Hingedly attached to main body 41, by a piano type hinge 45, or any other suitable hinge type is a leading inclined approach ramp 46. Approach ramp 46 is configured such that when folded into the storage configuration, as illustrated in FIG. 12, a solid rectangular block is obtained for ease of storage during non use periods.

FIGS. 11 through present a further alternate embodiment of my automotive wheel ramp 42 wherein a foldable end block or wheel barrier 65 has been hingedly attached to main body 41 by hinge straps 67A and 67B. Barrier 65 is conveniently stored by folding it atop main body 41 as illustrated in FIGS. 12 and 13. For use, barrier 65 is rotated, upon hinges 67A and 67B, into its functional position as illustrated in FIG. 11 whereby barrier 65 acts as a vehicle wheel stop thereby preventing the vehicle wheel overrunning upper surface 42 as the vehicle is maneuvered into position upon the ramp. Although wheel barrier 65 is illustrated as being foldable about hinges 67A and 67B, barrier 65 may alternately be permanently affixed to main body 41.

Figure 14:
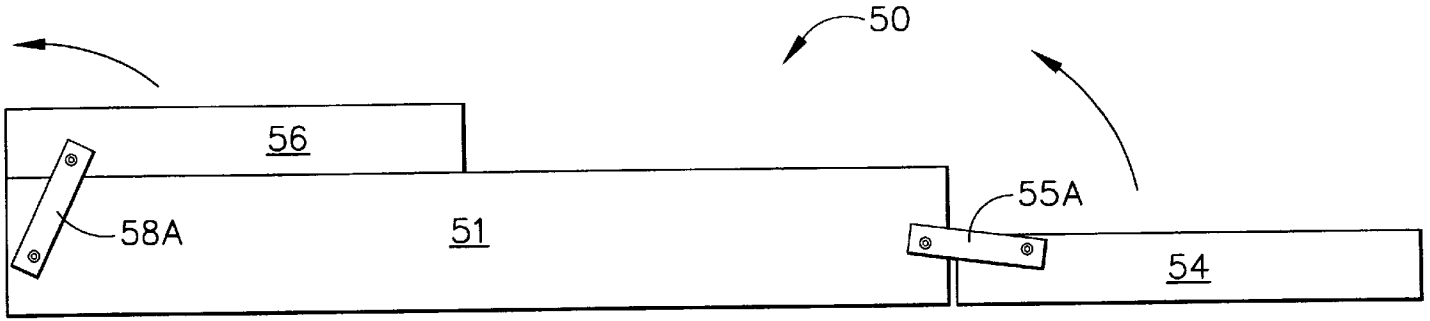
FIG. 14 presents a side elevational view of the fourth embodiment of my ramp in its unfolded functional configuration.
Figure 15:
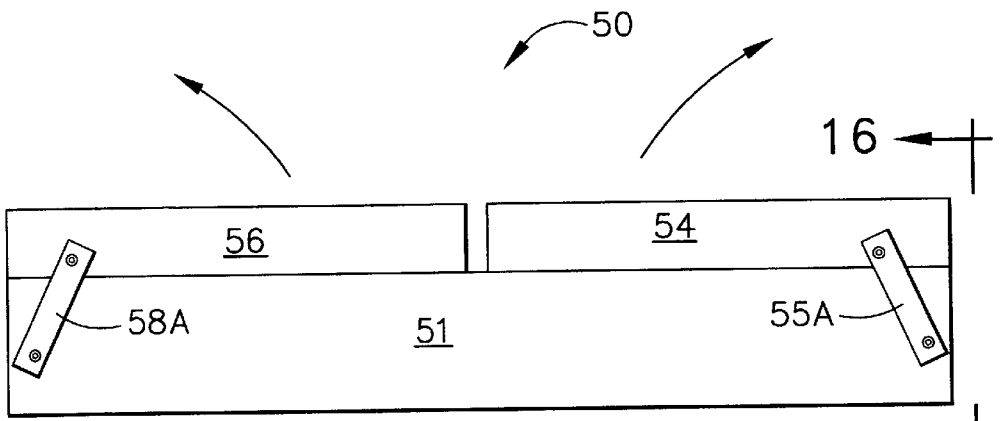
FIG. 15 presents a side elevational view of a fourth embodiment of my ramp in its folded or stored configuration.
Figure 16:
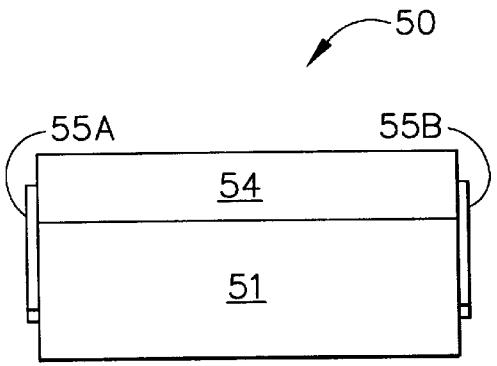
FIG. 16 presents an end elevational view, taken along line 16—16 in FIG. 15, showing the fourth embodiment of my ramp in its folded or stored configuration.

FIGS. 14 through 16 present a fourth alternate embodiment of my improved automotive vehicle maintenance ramp. Ramp 50 comprises a main body 51 which similar to main body 20 (FIG. 1) is approximately two courses high. Hingedly attached to main body 51 is approach step 54 which is foldable as shown in FIG. 15 and functions as that of leading step 25 in FIG. 1. Also hingedly attached to main body 51 is a third course 56 which may be left in place as illustrated in FIGS. 14 through 16 thereby providing a three stepped ramp similar to that illustrated in FIG. 1; or may be folded outward as indicated by the arrow in FIGS. 14 and 15 thereby presenting a two stepped ramp approachable from either end. Thus by the embodiment as illustrated in FIGS. 14 through 16 an adjustable vehicle maintenance ramp having two stair steps or three stair steps is available.

It is to be understood that the forms of the invention shown and described herein are but preferred embodiments thereof and that various changes and modifications can be made therein by one of ordinary skill in the art without departing from the spirit or scope of the appended claims.

What is claimed is:

1. A stepped portable automotive elevating ramp adapted to rest upon a supporting surface for supporting a vehicle wheel thereon, said ramp comprising a main body having a topmost course and a middle course included therein and a third lower level leading course, each of said stepped courses forming a separate horizontal, wheel supporting, surface that supports said vehicle wheel at a height above said supporting surface greater than that of the preceding course, said lower leading course hingedly attached to said main body wherein said lower leading course is foldable atop said middle course wherein said wheel supporting surface of said lower leading course is juxtaposed said wheel supporting surface of said middle course for storage of said ramp.

2. The stepped portable automotive elevating ramp as claimed in claim 1 wherein at least a portion of the wheel supporting surface of each of said courses includes a friction increasing surface.

3. The stepped portable automotive elevating ramp as claimed in claim 2 wherein at least a portion of the bottom side of said main body includes a friction increasing surface.

4. The stepped portable automotive elevating ramp as claimed in claim 2 wherein at least a portion of the bottom side of said leading course includes a friction increasing surface.

5. The stepped portable automotive elevating ramp as claimed in claim 1 wherein said main body includes a wheel barrier comprising a block hingedly attached to said main body whereby said block is foldable atop said main body for storage of said ramp when not in use and unfolded into its functional position whereby said block extends upward above said top most course of said ramp thereby providing a barrier for preventing said vehicle wheel from rolling off said ramp.

6. The stepped portable automotive elevating ramp as claimed in claim 1 wherein said topmost course is hinged to said main body middle course, whereby said top most course may be positioned as a second lower leading course opposite said other lower leading course thereby permitting said vehicle wheel to be driven upward upon said main body middle course from either end.

* * * * *